US008999116B2

(12) United States Patent
Sugita et al.

(10) Patent No.: US 8,999,116 B2
(45) Date of Patent: Apr. 7, 2015

(54) METHOD AND APPARATUS FOR PRODUCING SOLID FUEL

(75) Inventors: Satoru Sugita, Takasago (JP); Tetsuya Deguchi, Takasago (JP); Takuo Shigehisa, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 760 days.

(21) Appl. No.: 13/290,466

(22) Filed: Nov. 7, 2011

(65) Prior Publication Data

US 2012/0079763 A1 Apr. 5, 2012

Related U.S. Application Data

(62) Division of application No. 12/517,295, filed as application No. PCT/JP2007/073492 on Dec. 5, 2007, now Pat. No. 8,075,643.

(30) Foreign Application Priority Data

Dec. 13, 2006 (JP) ..... 2006-335996

(51) Int. Cl.
*C10B 9/00* (2006.01)
*C10L 9/10* (2006.01)

(52) U.S. Cl.
CPC ..... *C10L 9/10* (2013.01)

(58) Field of Classification Search
USPC ..... 44/626, 629, 282; 202/96, 265, 270
See application file for complete search history.

(56) References Cited

U.S. PATENT DOCUMENTS 4,421,632 A * 12/1983 Wurfel ..... 208/430
5,554,201 A * 9/1996 Yagaki et al. ..... 44/626
5,556,436 A * 9/1996 Yagaki et al. ..... 44/626
6,626,966 B2 9/2003 Shimasaki et al.
7,431,744 B2 * 10/2008 Sugita et al. ..... 44/282
7,628,827 B2 * 12/2009 Sugita et al. ..... 44/629
8,075,643 B2 * 12/2011 Sugita et al. ..... 44/626
8,252,070 B2 * 8/2012 Sugita et al. ..... 44/282
8,523,961 B2 * 9/2013 Sugita et al. ..... 44/592
8,734,544 B2 * 5/2014 Sugita et al. ..... 44/629

(Continued)

FOREIGN PATENT DOCUMENTS

JP 7 233383 9/1995

OTHER PUBLICATIONS

U.S. Appl. No. 13/124,133, filed Apr. 14, 2011, Sugita, et al.

(Continued)

*Primary Examiner* — Nina Bhat

(74) *Attorney, Agent, or Firm* — Oblon, McClelland, Maier & Neustadt, L.L.P.

(57) ABSTRACT

An apparatus for producing a solid fuel which may be made by a method involving mixing porous coal with a mixed oil containing heavy oil and solvent oil to prepare a raw material slurry; heating the raw material slurry to promote dehydration of the porous coal while impregnating the mixed oil into pores of the porous coal to obtain a dehydrated slurry; separating the resulting upgraded porous coal and mixed oil from the dehydrated slurry; drying the separated upgraded porous coal with carrier gas, and subsequently condensing vaporized mixed oil in the carrier gas by cooling, while capturing the porous coal in the carrier gas by atomization of the condensed mixed oil, thereby recovering the mixed oil; and returning the mixed oil separated and recovered in the separating to the mixing, further involving supplying the mixed oil recovered in the final drying to the separating.

14 Claims, 9 Drawing Sheets

(56) References Cited

U.S. PATENT DOCUMENTS

| | | | |
|---|---|---|---|
| 2005/0097814 | A1 | 5/2005 | Sugita et al. |
| 2005/0204615 | A1 | 9/2005 | Sugita et al. |
| 2007/0062103 | A1 | 3/2007 | Sugita et al. |
| 2011/0005126 | A1 | 1/2011 | Sugita et al. |
| 2011/0284671 | A1 | 11/2011 | Yamamoto et al. |

OTHER PUBLICATIONS

U.S. Appl. No. 13/120,369, filed Apr. 1, 2011, Yamamoto, et al.

* cited by examiner

METHOD AND APPARATUS FOR PRODUCING SOLID FUEL

CROSS REFERENCE TO RELATED APPLICATIONS

The present application is a divisional application based on U.S. application Ser. No. 12/517,295 which was the national stage of international application PCT/JP2007/073492, filed on Dec. 5, 2007, and claims the benefit of the filing date of Japanese Application No. 2006-335996, filed on Dec. 13, 2006, the text of each of which is incorporated by reference.

TECHNICAL FIELD

The present invention relates to a method and an apparatus for producing a solid fuel using porous coal as raw material.

BACKGROUND ART

With respect to the method for producing a porous coal-based solid fuel, for example, a method described in Patent Literature 1 is conventionally known. This method will be roughly described in reference to FIG. 8. Porous coal (raw material coal) is pulverized in a pulverization step, and then mixed with a mixed oil containing a heavy oil and a solvent oil in a mixing step to prepare a raw material slurry. The raw material slurry is preheated, and then heated in an evaporation step to promote dehydration of the porous coal while impregnating the mixed oil into pores of the porous coal to obtain a dehydrated slurry. Thereafter, a resulting upgraded porous coal and the mixed oil are separated from the dehydrated slurry in a solid-liquid separation step, and the separated upgraded porous coal is dried in a final drying step. The dried upgraded porous coal is subjected to cooling and Briquetting as requested to obtain a solid fuel. On the other hand, the mixed oil which is recovered in the solid-liquid separation step and the final drying step is circulated and carried to the mixing step for preparing the raw material slurry, and reused therein as circulating oil.

In the above-mentioned method, since the upgraded porous coal separated in the solid-liquid separation step is generally dried with a carrier gas in the final drying step, vaporized mixed oil and dust coal of the porous coal are consequently included in the carrier gas after drying. Therefore, prior to the reuse of the carrier gas, the vaporized mixed oil in the carrier gas is condensed and removed by cooling, and the dust coal is captured and removed by atomization of the mixed oil. As a result, the dust coal is included in the recovered mixed oil in relatively large quantity.

In a drying device using carrier gas (CG), for example, as shown in FIG. 9, an upgraded porous coal cake 52 separated in the solid-liquid separation step is heated to vaporize the mixed oil, particularly, the solvent oil in the cake in a dryer 51. Simultaneously, the vaporized oil is transferred and removed from the dryer 51 over the carrier gas (CG) to thereby obtain an upgraded porous coal 53. Since the carrier gas (CG) including the vaporized oil entrains also the dust coal, the dust coal is removed in a dust collecting device 54 as requested. However, generally, the dust coal cannot be sufficiently removed even by the dust collecting device 54. Therefore, in a gas cooler 55, the dust coal in the carrier gas is captured and removed by atomizing the mixed oil as circulating oil (CO) while condensing the vaporized oil by cooling. Consequently, the dust coal is included in a recovered mixed oil 56 in relatively large quantity.

Patent Literature 1: Japanese Patent Application Laid-Open No. Hei7-233383

DISCLOSURE OF THE INVENTION

Means to be Solved by the Invention

Since the dust coal is included in the mixed oil recovered in the final drying step in relatively large quantity as described above, the reuse of the mixed oil as circulating oil in the mixing step results in increased dust coal concentration in the circulating oil with repeated circulation.

It has been pointed out that the following problems are caused due to the increase in dust coal concentration in the circulating oil.

(1) The increased dust coal concentration in the raw material slurry prepared using the circulating oil makes it hard to heat the raw material slurry in the preheating step and the evaporation step.

(2) The increased dust coal concentration in the slurry prepared using the circulation oil causes reduction in treatment rate in the solid-liquid separation step, resulting in reduced solid-liquid separation capacity.

The present invention thus has an object to provide a method and an apparatus for producing a solid fuel, which never cause the above-mentioned problems attributed from the dust coal in circulating oil.

In the specification, the dust coal means, for example, pulverized coal having a particle size of 45 μm or less, particularly, 10 μm or less, which is generated by pulverization of the porous coal contained in the slurry through transfer, circulation or the like of the slurry.

Means for Solving the Problem

A method for producing a solid fuel according to the present invention comprises:

a mixing step of mixing porous coal with a mixed oil containing a heavy oil and a solvent oil to prepare a raw material slurry;

an evaporation step of heating the raw material slurry to promote dehydration of the porous coal while impregnating the mixed oil into pores of the porous coal to obtain a dehydrated slurry;

a solid-liquid separation step of separating a resulting upgraded porous coal and the mixed oil from the dehydrated slurry;

a final drying step of drying the separated upgraded porous coal with a carrier gas, and subsequently condensing a vaporized mixed oil in the carrier gas by cooling, while capturing the porous coal in the carrier gas by atomization of the condensed mixed oil, thereby recovering the mixed oil; and a circulation step of returning the mixed oil separated and recovered in the solid-liquid separation step to the mixing step, in which the method is characterized by further comprising a supply step A of supplying the mixed oil recovered in the final drying step to the solid-liquid separation step.

An apparatus for producing a solid fuel according to the present invention comprises:

mixing means for mixing porous coal with a mixed oil containing a heavy oil and a solvent oil to prepare a raw material slurry;

evaporation means for heating the raw material slurry to promote dehydration of the porous coal while impregnating the mixed oil into pores of the porous coal to obtain a dehydrated slurry;

solid-liquid separation means for separating a resulting upgraded porous coal and the mixed oil from the dehydrated slurry;

drying means for drying the separated upgraded porous coal with a carrier gas, and subsequently condensing a vaporized mixed oil in the carrier gas by cooling, while capturing the porous coal in the carrier gas by atomization of the condensed mixed oil, thereby recovering the mixed oil; and circulation means for returning the mixed oil separated and recovered by the solid-liquid separation means to the mixing means, in which the apparatus is characterized by further comprising supply means A for supplying the mixed oil recovered by the drying means to the solid-liquid separation means.

Effect of Invention

According to the present invention, since the mixed oil recovered in the final drying step is passed through the solid-liquid separation step prior to the reuse in the mixing step, the increase in dust coal concentration in circulating oil can be suppressed. Therefore, the raw material slurry can be easily heated in the preheating step and the evaporation step.

When the solid-liquid separation step is carried out through multiple stages, particularly, the solid-liquid separation capacity can be improved by supplying the mixed oil recovered in the final drying step to the second solid-liquid separation step, or the solid-liquid separation step thereafter.

DESCRIPTION OF NUMERAL REFERENCE

2: Mixing tank, 3: Preheater, 4: Evaporator, 5; 5*a*; 5*b*: Solid-liquid separator, 6: Dryer, 7: Drying device, 10: Dehydrated slurry, 11: Solid content (upgraded porous coal), 12: Dust collecting device, 13: Gas cooler, 14: Gas heater, 15: Heater, 16: Recovered mixed oil, 17; 18: Liquid content (mixed oil), 21: Upgraded porous coal, 52: Upgraded porous coal cake, 53: Upgraded porous coal, 54: Dust collecting device, 55: Gas cooler, 56: Recovered mixed oil

BEST MODE FOR CARRYING OUT THE INVENTION

Solid fuel is basically produced from porous coal through the following steps:

a mixing step of mixing porous coal with a mixed oil containing a heavy oil and a solvent oil to prepare a raw material slurry;

an evaporation step of heating the raw material slurry to promote dehydration of the porous coal while impregnating the mixed oil into pores of the porous coal to obtain a dehydrated slurry;

a solid-liquid separation step of separating a resulting upgraded porous coal and the mixed oil from the dehydrated slurry;

a final drying step of drying the separated upgraded porous coal with a carrier gas, and subsequently condensing a vaporized mixed oil in the carrier gas by cooling, while capturing the porous coal in the carrier gas by atomization of the condensed mixed oil, thereby recovering the mixed oil; and a circulation step of returning the mixed oil separated and recovered in the solid-liquid separation step to the mixing step.

The present invention is characterized in that a supply step A of supplying the mixed oil recovered in the final drying step to the solid-liquid separation step is included in the above-mentioned manufacturing process.

Each of the steps will be described in detail in reference to FIGS. 1 to 6.

Figure 1:
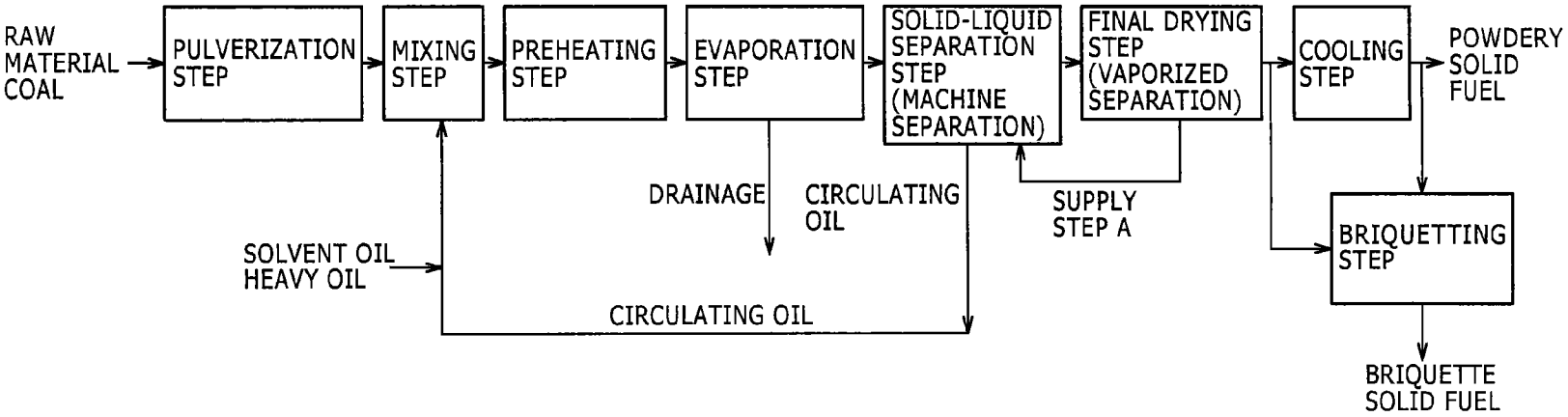
FIG. 1 is a process flow chart showing one embodiment of a method for producing a solid fuel according to the present invention.

In the mixing step, porous coal is mixed with a mixed oil containing a heavy oil and a solvent oil to prepare a raw material slurry (Mixing step in FIG. 1).

The porous coal means so-called low rank coal which contains a large quantity of moisture and should be dehydrated, for example, coal containing as high as 20 to 70 wt % of moisture. Examples of such porous coal include brown coal, lignite, and sub-bituminous coal. Examples of the brown coal include Victorian coal, North Dakota coal, and Berga coal, and examples of the sub-bituminous coal include West Bango coal, Binungan coal, Samarangau coal, and Eco-coal coal. The porous coal of the present invention is never limited by the above-mentioned examples, and any coal which contains a large quantity of moisture and should be dehydrated is included in the porous coal of the present invention. The porous coal is generally pulverized prior to use (Pulverization step in FIG. 1). The particle size of the porous coal is not particularly limited and, for example, may be about 0.05 to 2.0 mm, particularly, 0.1 to 0.5 mm in terms of average particle size.

The heavy oil means, for example, a heavy oil fraction such that it shows substantially no vapor pressure even at 400° C. such as vacuum residual oil, or an oil high in this fraction. Therefore, when only the heavy oil is used and forced to be heated until it shows fluidity such that it can be impregnated into pores of the porous coal, the porous coal itself causes thermal decomposition. Since the heavy oil used in the present invention hardly shows the vapor pressure as described above, it is more impossible to vaporize and deposit it over the carrier gas. Consequently, using only the heavy oil, its high viscosity makes it difficult to ensure a satisfactory slurry state, but also substantially no volatility of the heavy oil deteriorates the impregnation property to pores. Accordingly, cooperation with some kind of solvent or dispersant is needed.

In the present invention, therefore, the heavy oil is dissolved in a solvent oil, prior to use to improve the impregnation activity and slurry forming property. As the solvent oil for dispersing the heavy oil, a light oil is preferably used from the viewpoint of amity with the heavy oil, handling property as slurry, easiness in impregnation into pores, or the like, and it is recommended to use a petroleum oil having a boiling point of 100° C. or higher, preferably 300° C. or lower (light oil, heavy oil, etc.), considering the stability at a moisture evaporation temperature. When such heavy oil-containing mixed oil is used, the impregnation into pores can be promoted to a level such that it cannot be attained solely by the heavy oil since this mixed oil shows appropriate fluidity.

The heavy oil-containing mixed oil as described above may be (a) a one obtained as a mixed oil originally containing both the heavy oil and the solvent oil or (b) a one obtained by mixing the heavy oil with the solvent oil. As the former (a), for example, petroleum-derived heavy oil; petroleum-derived light oil fraction, kerosene fraction, or lubricant component, which is unpurified and contains heavy oil; coal tar; light oil or kerosene, which includes heavy oil impurities resulting from the use as solvent or detergent; heat medium oil, which includes a deteriorated fraction resulting from the repeated use; and the like are used. As the latter (b), for example, a mixture of petroleum asphalt, natural asphalt, coal-derived heavy oil, petroleum-derived or coal-derived distillation residue, or a one high in such substance, with petroleum-derived light oil, kerosene, lubricant or the like; a dilution of the mixed oil of the former (a) with petroleum-derived light oil, kerosene, or lubricant; and the like are used. The asphalts are particularly suitably used since they are inexpensive and have the feature of hardly separating from an active point after once adhering thereto.

The content of the heavy oil in the mixed oil is generally in the range between 0.25 and 15% by weight ratio relative to the whole quantity of the mixed oil.

The mixing ratio of mixed oil to porous coal is not particularly limited. In general, it is appropriate to set the mixing ratio of heavy oil to porous coal in the range of 0.5 and 30%, particularly of 0.5 and 5% by weight ratio in terms of anhydrous coal. When the mixing ratio of heavy oil is too small, the effect of suppressing spontaneous combustibility is weakened due to insufficient adsorbed amount to pores. When the mixing ratio of the heavy oil is too large, the economic efficiency is reduced due to increased oil cost.

The mixing condition is not particularly limited, and the mixing is generally performed at 40 to 100° C. in the atmospheric pressure.

The raw material slurry obtained in the mixing step is generally preheated prior to the evaporation step (Preheating step in FIG. 1). The preheating step may be omitted.

The preheating condition is not particularly limited.

In the evaporation step, the raw material slurry is heated to promote dehydration of the porous coal while impregnating the mixed oil into pores of the porous coal to obtain a dehydrated slurry (Evaporation step in FIG. 1). Namely, the raw material slurry is heated to, for example, 100 to 250° C. According to this, the moisture in the pores of the porous coal is vaporized and evaporated, and the mixed oil enters the resulting empty parts and adhered thereto. Thus, the adhesion and coating of the mixed oil is performed in accordance with the progress of vaporization and evaporation of the moisture in the pores. Even if steam is slightly left, the surface layer part of the pores is successively coated with the heavy oil-containing mixed oil, since a negative pressure is generated during the concentration of the steam in the cooling process to suck the heavy oil-containing mixed oil into the pores, and almost the whole area of the pore opening parts is consequently filled up with the heavy oil-containing mixed oil. Furthermore, since the heavy oil in the mixed oil tends to be easily and selectively adsorbed to an active point and be hardly separated once adhered, the heavy oil is consequently expected to adhere in preference to the solvent oil. The spontaneous combustibility can be thus deadened by interrupting the pore inner surface layer part from the outside air. The increase in calorie as the whole porous coal can be inexpensively attained since the heavy oil-containing mixed oil, particularly, the heavy oil is preferentially filled in the pores in addition to dehydration and removal of a large quantity of moisture.

The heating is preferably performed under increased pressure, which is generally suitable to be 200 to 1500 kPa.

The heating time cannot be simply regulated since a series of steps is carried out by continuous operation usually, and the heating time is set such that the dehydration of the porous coal and the impregnation of the mixed oil into the pores can be attained.

The steam generated by heating in the evaporation step is removed. The steam generated and removed in this step can be used as a heating source in the preheating step and the evaporation step by recovering and pressurizing it.

In the solid-liquid separation step, the separation of upgraded porous coal and mixed oil from the dehydrated slurry is performed in one stage or multiple stages (Solid-liquid separation step in FIG. 1).

Various methods can be used for the separation. For example, centrifugal separation, sedimentation, filtration, expression or the like is adoptable. These methods can be used in combination. The centrifugal separation is preferred from the viewpoint of separation efficiency.

The mixed oil separated and recovered in the solid-liquid separation step is returned to the mixing step, and circularly used as a medium for forming the raw material slurry (circulating oil) (Circulation step).

The solid content (upgraded porous coal) separated and recovered in the solid-liquid separation step is dried since it is generally wetted still with the mixed oil (Final drying step in FIG. 1).

The drying method is not particularly limited as long as the mixed oil, particularly, the solvent oil can be separated by vaporization and recovered from the upgraded porous coal. In general, a drying device using carrier gas such as nitrogen gas is preferably used from the viewpoint of drying efficiency. Such a drying device comprises, for example, a dryer 6, a gas cooler 13, and a gas heater 14 as shown in FIG. 2, and generally further comprises a dust collecting device 12 and a heater 15.

Figure 2:
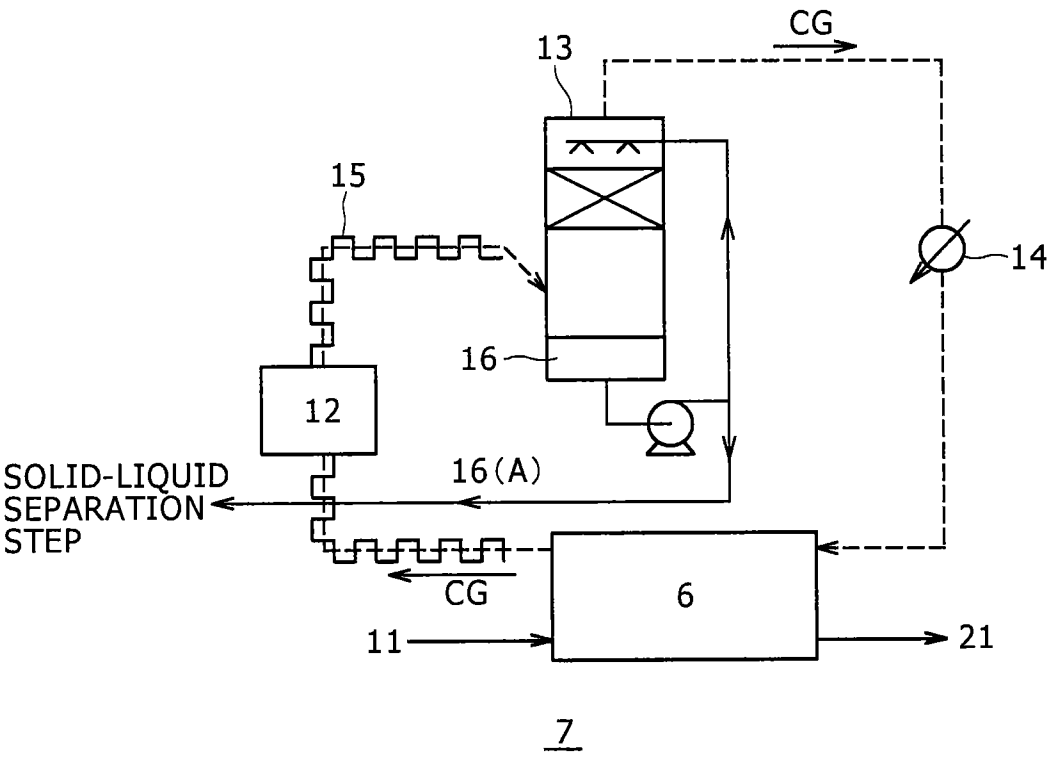
FIG. 2 is a schematic view showing one embodiment of a final drying step in the method for producing a solid fuel according to the present invention.

In a drying device 7 shown in FIG. 2, an upgraded porous coal (cake) 11 separated in the solid-liquid separation step is dried with carrier gas CG in the dryer 6. Thereafter, the vaporized mixed oil in the carrier gas is condensed by cooling, while the porous coal (dust coal) in the carrier gas is captured by atomization of the condensed mixed oil, whereby a mixed oil 16 is recovered. For details, the upgraded porous coal (cake) 11 is heated to, for example, about 200° C. in the dryer 6 to vaporize the oil content in the cake, particularly, the solvent oil. At the same time, the vaporized oil is transferred and removed from the dryer 6 over the carrier gas (CG), whereby a dried porous coal 21 is obtained. Since the carrier gas (CG) including the vaporized oil entrains also dust coal, the dust coal is generally removed in the dust collecting device 12. Since the resulting carrier gas still includes the dust coal, the vaporized oil is condensed by cooling, and the dust coal in the carrier gas is captured and removed by atomization of the condensed mixed oil in the gas cooler 13, whereby the mixed oil 16 is recovered. The carrier gas (CG) from which the dust coal and the vaporized oil are removed is heated by the gas heater 14 and circulated for use in the dryer 6. The heater 15 is generally disposed in a carrier gas pipe leading from the dryer 6 to the dust collecting device 12 and in a carrier gas pipe leading from the dust collecting device 12 to the gas cooler 13 for preventing condensation of the vaporized oil during carrying of the carrier gas. As the dryer 6, a dryer capable of heating a treatment object while continuously carrying the treatment object in the inner part thereof, or a steam tube type dryer having a plurality of heating steam tubes axially disposed on a drum inner surface is generally used.

The mixed oil 16 recovered in this step is supplied back to the solid-liquid separation step while a part thereof is circulated and used for atomization for capturing the dust coal as shown in FIG. 2 (Supply step A in FIG. 1). From the viewpoint of preventing clogging of piping due to increased dust coal concentration, new mixed oil, particularly, solvent oil (not shown) may be supplied and mixed to the mixed oil 16.

When the mixed oil 16 recovered in the final drying step is supplied to the solid-liquid separation step, in the case where the solid-liquid separation step is carried out in multiple stages, it is preferred to supply the mixed liquid 16 recovered in the final drying step to the second solid-liquid separation step, or the solid-liquid separation step thereafter. When the solid-liquid separation step is composed of the first solid-liquid separation step and the second solid-liquid separation step, for example, it is preferred to supply the mixed oil 16 to the second solid-liquid separation step. According to this, the reduction in treatment rate as the whole solid-liquid separation step can be suppressed.

When the solid-liquid separation step is carried out in multiple stages, and the mixed liquid 16 is supplied to the second solid-liquid separation step, or the solid-liquid separation step thereafter, it is preferred to supply and mix the mixed liquid separated in the first solid-liquid separation step to the mixed liquid 16 recovered by the gas cooler 13 in the final drying step (Supply step B) from the viewpoint of effective use of the mixed liquid.

When the solid-liquid separation step is carried out in two stages, for example, the following embodiments are given as a concrete example of the solid-liquid separation step and the final drying step. Of these embodiments, embodiments 1 and 2 are preferred, and embodiment 1 is more preferred.

Embodiment 1

Figure 3:
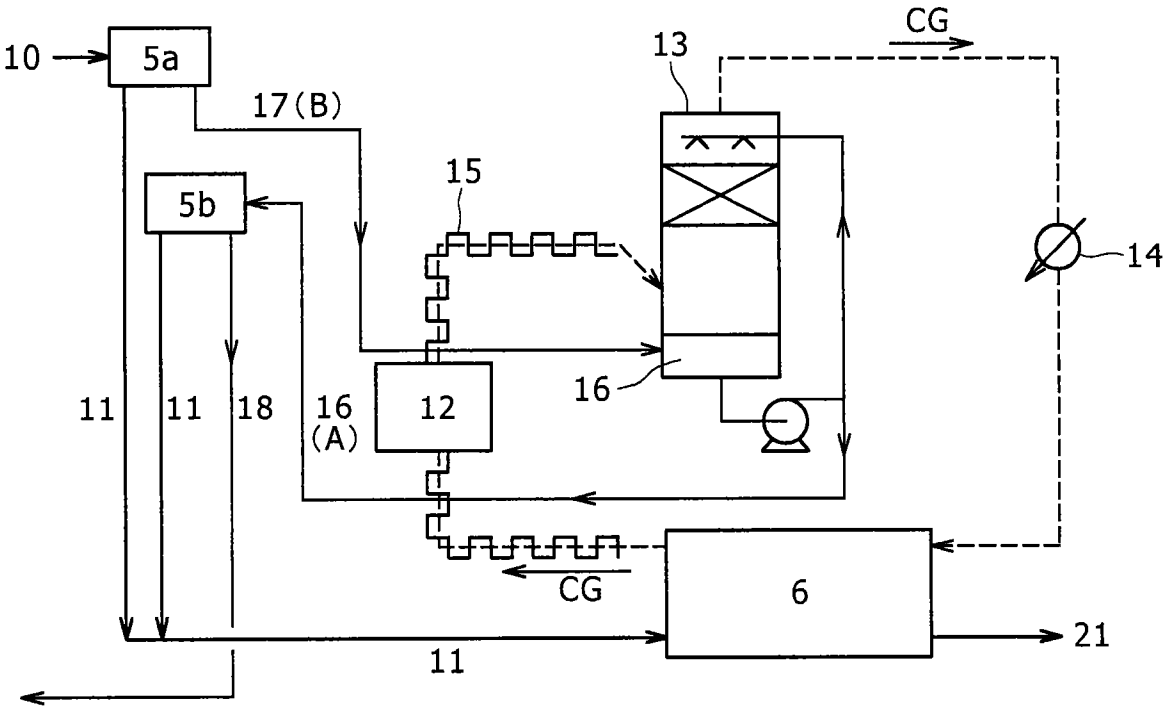
FIG. 3 is a schematic view showing one embodiment of the solid-liquid separation step and a final drying step in the method for producing a solid fuel according to the present invention.

When the solid-liquid separation step is carried out in two stages using a first solid-liquid separator 5*a* and a second solid-liquid separator 5*b* as shown in FIG. 3, a dehydrated slurry 10 obtained in the evaporation step is treated in the first solid-liquid separator 5*a* to separate an upgraded porous coal 11 from a mixed liquid 17 (First solid-liquid separation step). The mixed liquid 17 is supplied and mixed to a mixed liquid 16 recovered in the final drying step (Supply step B). The mixed liquid 16 recovered in the final drying step is supplied to the second solid-liquid separator 5*b* (Supply step A) and separated into an upgraded porous coal 11 based on dust coal in the mixed oil 16 and a mixed oil 18 (Second solid-liquid separation step). The upgraded porous coal 11 separated in the first solid-liquid separation step and the second solid-liquid separation step is supplied to and dried in the dryer 6 in the final drying step, while the mixed liquid 18 separated in the second solid-liquid separation step is returned to the mixing step (Circulation step). The description for the final drying step in FIG. 3 is omitted since it is the same as that for the final drying step shown in FIG. 2.

Embodiment 2

Figure 4:
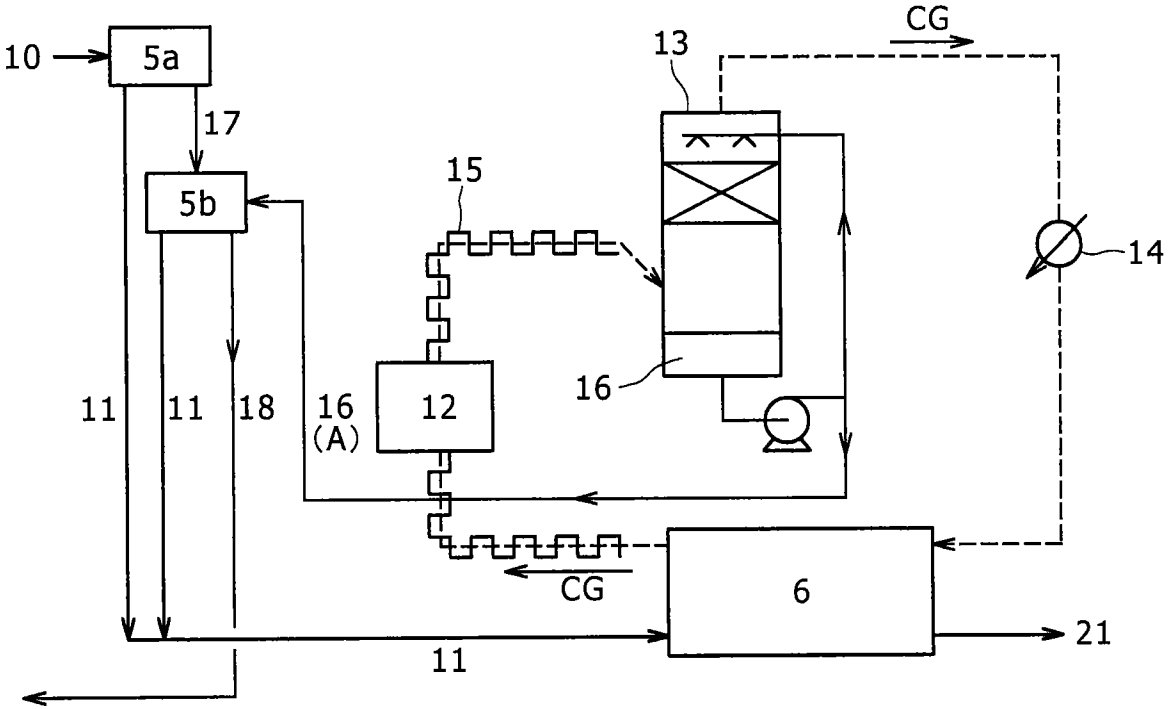
FIG. 4 is a schematic view showing another embodiment of the solid-liquid separation step and final drying step in the method for producing a solid fuel according to the present invention.

When the solid-liquid separation step is carried out in two stages using the first solid-liquid separator 5*a* and the second solid-liquid separator 5*b* as shown in FIG. 4, the dehydrated slurry 10 obtained in the evaporation step is treated in the first solid-liquid separator 5*a* to separate the upgraded porous coal 11 from the mixed liquid 17 (First solid-liquid separation step). The mixed liquid 16 recovered in the final drying step is supplied to the second solid-liquid separator 5*b* (Supply step A), and solid-liquid separated together with the mixed liquid 17 separated in the first solid-liquid separation step (Second solid-liquid separation step). As a result, the mixed liquid 16 is separated into the upgraded porous coal 11 and the mixed oil 18. The upgraded porous coal 11 separated in the first solid-liquid separation step and the second solid-liquid separation step is supplied to and dried in the dryer 6 in the final drying step, while the mixed liquid 18 separated in the second solid-liquid separation step is returned to the mixing step (Circulation step). The description for the final drying step in FIG. 4 is omitted since it is the same as that for the final drying step shown in FIG. 2.

Embodiment 3

Figure 5:
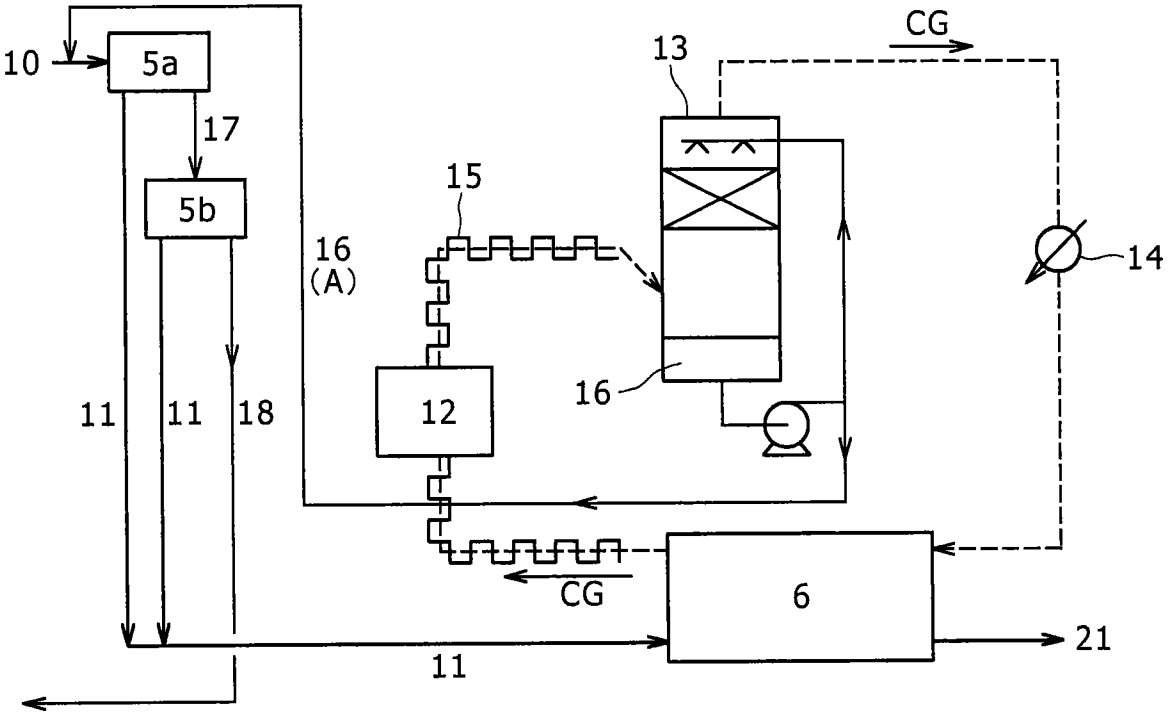
FIG. 5 is a schematic view showing the other embodiment of the solid-liquid separation step and final drying step in the method for producing a solid fuel according to the present invention.

When the solid-liquid separation step is carried out in two stages using the first solid-liquid separator 5*a* and the second solid-liquid separator 5*b* as shown in FIG. 5, the mixed liquid 16 recovered in the final drying step is supplied to the first solid-liquid separator 5*a* (Supply step A), and solid-liquid separated together with the dehydrated slurry 10 obtained in the evaporation step (First solid-liquid separation step). As a result, the mixed liquid 16 is separated into the upgraded porous coal 11 and the mixed oil 17. The separated mixed oil 17 is then treated in the second solid-liquid separator 5*b* to separate the upgraded porous coal 11 from the mixed oil 18 (Second solid-liquid separation step). The upgraded porous coal 11 separated in the first solid-liquid separation step and the second solid-liquid separation step is supplied to and dried in the dryer 6 in the final drying step, while the mixed liquid 18 separated in the second solid-liquid separation step is returned to the mixing step (Circulation step). The description for the final drying step in FIG. 5 is omitted since it is the same as that for the final drying step shown in FIG. 2.

Further, when the solid-liquid separation step is carried out in one stage, the following embodiment can be given as a concrete example.

Embodiment 4

Figure 6:
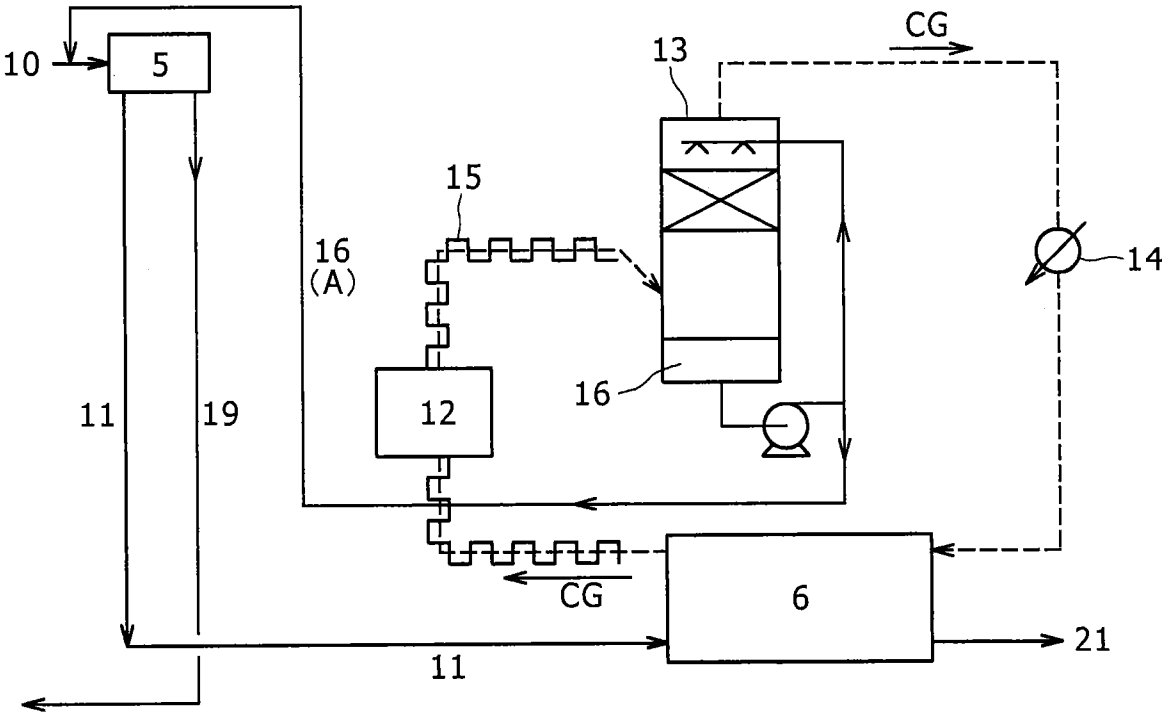
FIG. 6 is a schematic view showing further the other embodiment of the solid-liquid separation step and final drying step in the method for producing a solid fuel according to the present invention.

When the solid-liquid separation step is carried out in one stage using only the first solid-liquid separator 5 as shown in FIG. 6, the mixed liquid 16 recovered in the final drying step is supplied to the solid-liquid separator 5 (Supply step A), and solid-liquid separated together with the dehydrated slurry 10 obtained in the evaporation step (Solid-liquid separation step). As a result, the mixed liquid 16 is separated into the upgraded porous coal 11 and a mixed oil 19. The separated upgraded porous coal 11 is supplied to and dried in the dryer 6 in the final drying step, while the mixed liquid 19 is returned to the mixing step (Circulation step). The description for the final drying step in FIG. 6 is omitted since it is the same as that for the final drying step shown in FIG. 2.

The dried upgraded porous coal is cooled and briquetted as requested, whereby a solid fuel is obtained (Cooling step and Briquetting step of FIG. 1). For example, the porous coal can be used as a powdery solid fuel by cooling in the cooling step, otherwise as a Briquette solid fuel by further Briquetting in the Briquetting step after cooling in the cooling step. Further, the porous coal can be briquetted into a Briquette solid fuel in the Briquetting step without cooling.

Figure 7:
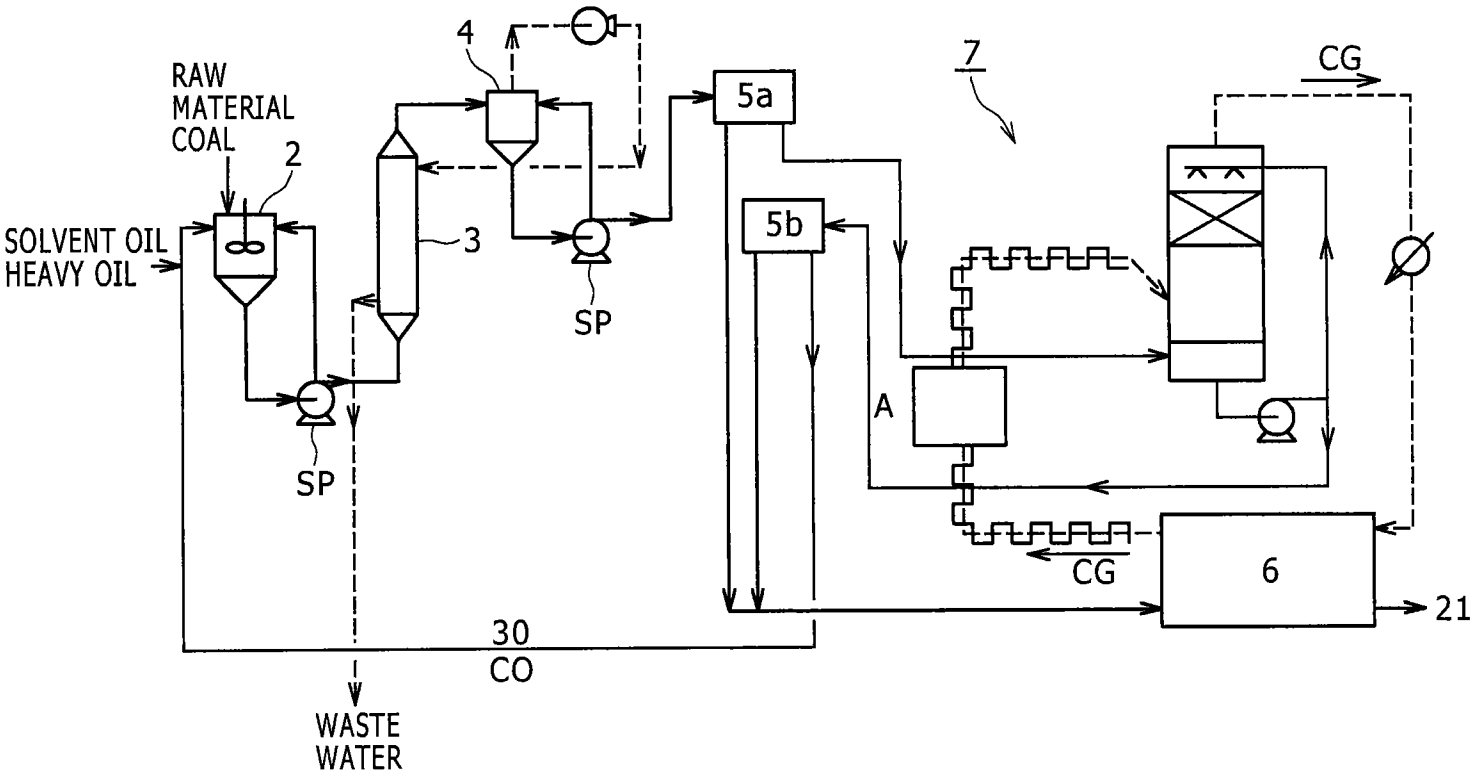
FIG. 7 is a schematic view showing one embodiment of an apparatus for producing a solid fuel according to the present invention.
Figure 8:
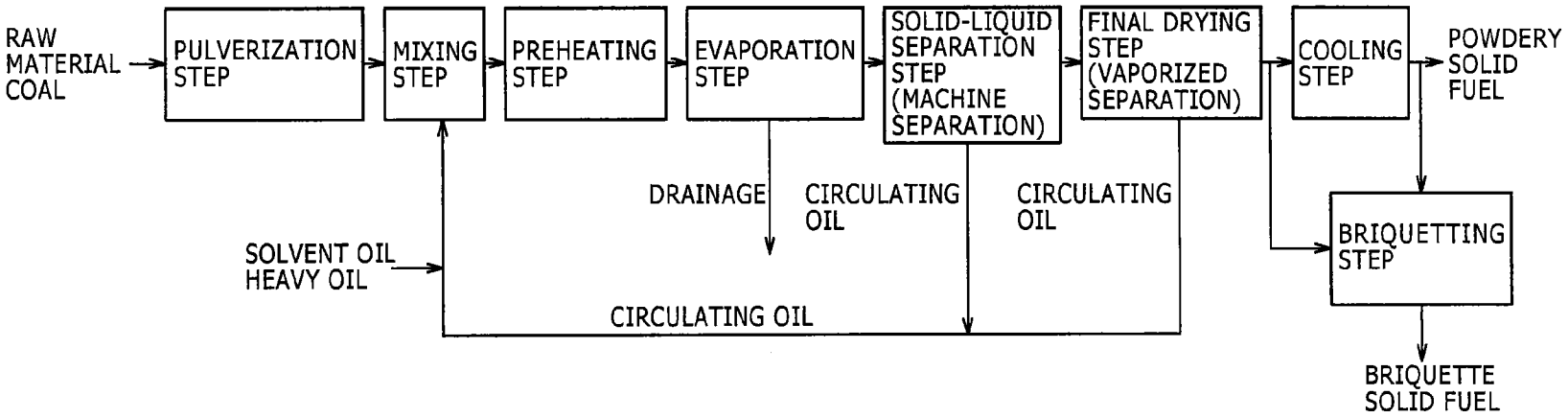
FIG. 8 is a process flow chart showing a method for producing a solid fuel in the related art.
Figure 9:
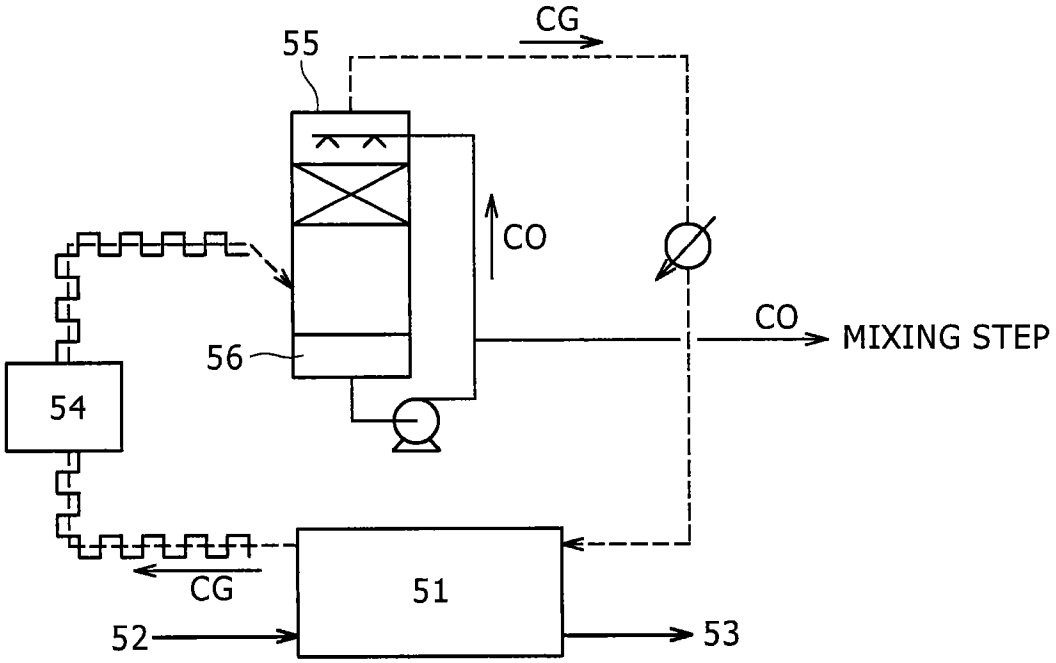
FIG. 9 is a schematic view showing a final drying step in the related art.

One embodiment of an apparatus for producing a solid fuel according to the present invention is schematically shown in FIG. 7. The embodiment of the apparatus for producing solid fuel in FIG. 7 adopts the pulverization step to the final drying step in the method for producing a solid fuel of the present invention shown in FIG. 1. For details, each of a pulverizing machine (not shown), a mixing tank 2, a preheater 3, an evaporator 4, a solid-liquid separator (5*a* and 5*b*) and a drying device 7 is means for carrying out the above-mentioned pulverization step, mixing step, preheating step, evaporation step, solid-liquid separation step and final drying step shown in FIG. 1. The above-mentioned embodiment 1 is adopted for the solid-liquid separator and the drying device.

The apparatus for producing a solid fuel according to the present invention comprises, for example, as shown in FIG. 7, at least, a mixing tank 2 for mixing porous coal with a mixed oil containing a heavy oil and a solvent oil to prepare a raw material slurry; an evaporator 4 for heating the raw material slurry to promote dehydration of the porous coal while impregnating the mixed oil into pores of the porous coal to obtain a dehydrated slurry; a solid-liquid separator(s) 5 (5*a*, 5*b*) for separating a resulting upgraded porous coal and the mixed oil from the dehydrated slurry; a drying device 7 for drying the separated upgraded porous coal with a carrier gas, and subsequently condensing a vaporized mixed oil in the carrier gas by cooling, while capturing the porous coal in the carrier gas by atomization of the condensed mixed oil, thereby recovering the mixed oil; and circulation means 30 for returning the mixed oil separated and recovered by the solid-liquid separator to the mixing tank, and the apparatus is characterized by further comprising supply means A for supplying the mixed oil recovered by the drying device to the solid-liquid separator.

The apparatus of the present invention generally includes, as shown in FIG. 7, a pulverizing machine (not shown) and a preheater 3, and further a cooler (not shown) and a Briquetting machine (not shown) as requested.

In FIG. 7, although the above-mentioned embodiment 1 is adopted for the solid-liquid separator and the drying device, the above-mentioned embodiments 2 to 4, for example, can be also adopted as long as supply means for supplying the mixed oil recovered in the drying device to the solid-liquid separator is included.

The steam generated in the evaporator 4 is compressed and used as a heating source of the preheater 3, and then disposed.

The carrier gas (CG) used in the drying device 7 is reused in the dryer 6 after removing the vaporized oil content and the dust coal in the same manner as in FIG. 2.

EXAMPLES

The present invention will be described in more detail according to the following examples, wherein "part" means "part by weight".

Example 1

The same apparatus as the apparatus of FIG. 7 except that it has no preheater was continuously operated in the following conditions.

[Pulverizing Step]

Samarangau coal (maximum particle size: 3000 μm, average particle size: about 150 μm)

[Mixing Step]

A raw material slurry was prepared by supplying newly prepared mixed oil [kerosene 1 kg/hr, asphalt 1 kg/hr] to Samarangau coal 180 kg/hr and circulating oil 248 kg/hr (70° C., 100 kPa).

[Evaporation Step]

Supply rate of raw material slurry to evaporator: 430 kg/hr 137° C., 400 kPa

[First Solid-Liquid Separation Step and Second Solid-Liquid Separation Step]

130° C., 100 kPa

[Final Drying Step]

Dryer: Steam tube dryer (heating temperature; about 200° C.)

Carrier gas: Nitrogen gas

[Supply Step A]

Supply rate: 240 kg/hr

[Circulation Step]

Circulation rate: 300 kg/hr

As a result of measurement, the dust coal concentration in the circulating oil just before circulated and supplied to the mixing tank 2 reached 9.5 wt % after 72 hours from the start of operation. The particle size of all the dust coal in the circulating oil was 10 μm or less. The dust coal concentration was shown by the ratio of the weight of dust coal having particle size of 10 μm or less to the whole quantity of the sampled circulating oil.

The treatment quantity in the first solid-liquid separator 5*a* after 72 hours from the start of operation was 405 kg/hr.

Comparative Example 1

The continuous operation was carried out by the same method as in Example 1, except that the mixed oil recovered in the final drying step was returned to the mixing oil as it was without providing the supply means A.

As a result of measurement, the dust coal concentration in the circulating oil just before circulated and supplied to the mixing tank 2 reached 12 wt % after 72 hours from the start of operation.

The treatment quantity in the first solid-liquid separator 5*a* after 72 hours from the start of operation was 410 kg/hr.

It is found from the above that the increase in dust coal concentration in the circulating oil can be suppressed by supplying the mixed oil recovered in the final drying step to the solid-liquid separation step during continuous operation. Further, it is found that the solid-liquid separation capacity is improved by supplying this mixed oil to the second solid-liquid separation step.

INDUSTRIAL USABILITY

The method and apparatus for producing a solid fuel according to the present invention are useful for production of a solid fuel using porous coal (coal), particularly, low rank coal as raw material.

The invention claimed is:

1. An apparatus comprising:

(A) a mixer to mix porous coal with a mixed oil containing a heavy oil and a solvent oil to prepare a raw material slurry;

(B) an evaporator connected to the mixer (A) and disposed on a downstream side of a flow of the raw material slurry with respect to the mixer (A), to heat the raw material slurry to promote dehydration of the porous coal while impregnating pores of the porous coal with the mixed oil to obtain a dehydrated slurry;

(C) a solid-liquid separator connected to the evaporator (B) and disposed on a downstream side of a flow of the dehydrated slurry with respect to the evaporator (B), to separate an upgraded porous coal and the mixed oil from the dehydrated slurry;

(D) a drying device to dry the upgraded porous coal to obtain a dried porous coal, comprising:

(D-1) a dryer connected to the solid-liquid separator (C) and disposed on a downstream side of a flow of the upgraded porous coal with respect to the solid-liquid separator (C), to dry the upgraded porous coal with a carrier gas, the dryer (D-1) comprising: an inlet of the carrier gas; and an outlet of the carrier gas, the carrier gas at the outlet including a dust coal and a vaporized mixed oil; and (D-2) a gas cooler disposed between the outlet of the carrier gas and the inlet of the carrier gas, to cool the carrier gas to condense the vaporized mixed oil in the carrier gas, while capturing the dust coal in the carrier gas by atomization of the condensed mixed oil, thereby recovering the mixed oil which includes the dust coal;

(E) a first return path disposed between the solid-liquid separator (C) and the mixer (A), to return the mixed oil separated and recovered by the solid-liquid separator (C) to the mixer (A); and (F) a second return path disposed between the solid-liquid separator (C) and the drying device (D), to return the mixed oil recovered by the drying device (D) to the solid-liquid separator (C).

2. The apparatus of claim 1, wherein the solid-liquid separator (C) comprises a centrifugal device.

3. The apparatus of claim 1, wherein the solid-liquid separator (C) comprises a sedimentation device.

4. The apparatus of claim 1, wherein the solid-liquid separator (C) comprises a filtration device.

5. The apparatus of claim 1, wherein the drying device (D) further comprises:

(D-3) a gas heater disposed between the gas cooler (D-2) and the inlet of the carrier gas of the dryer (D-1), to heat the carrier gas.

6. The apparatus of claim 1, wherein the drying device (D) further comprises:

(D-4) a dust collecting device disposed between the outlet of the carrier gas of the dryer (D-1) and the gas cooler (D-2), to collect at least a part of the dust coal in the carrier gas.

7. The apparatus of claim 1, wherein the drying element (D) further comprises:

(D-5) a heater disposed along a path between the outlet of the carrier gas of the dryer (D-1) and the gas cooler (D-2).

8. The apparatus of claim 1, wherein the drying device (D) is suitable for a pressure of 200 to 1500 kPa.

9. The apparatus of claim 1, wherein the dryer (D-1) is capable of heating the upgraded porous coal while continuously carrying the upgraded porous coal in an inner part of the dryer (D-1).

10. The apparatus of claim 1, wherein the dryer (D-1) comprises a steam tube dryer comprising a plurality of heating steam tubes axially disposed on a drum inner surface.

11. The apparatus of claim 1, wherein the solid-liquid separator (C) comprises:

(C-1) a first solid-liquid separator connected to the evaporator (B) to receive the dehydrated slurry; and (C-2) a second solid-liquid separator other than the first solid-liquid separator (C-1).

12. The apparatus of claim 11, wherein the upgraded porous coal separated from the dehydrated slurry by the first solid-liquid separator (C-1) is supplied to the gas cooler (D-2), and each of the first return path (E) and the second return path (F) is connected to the second solid-liquid separator (C-2).

13. The apparatus of claim 11, wherein the upgraded porous coal separated from the dehydrated slurry by the first solid-liquid separator (C-1) is supplied to the second solid-liquid separator (C-2), and each of the first return path (E) and the second return path (F) is connected to the second solid-liquid separator (C-2).

14. The apparatus of claim 11, wherein the upgraded porous coal separated from the dehydrated slurry by the first solid-liquid separator (C-1) is supplied to the second solid-liquid separator (C-2), the first return path (E) is connected to the second solid-liquid separator (C-2), and the second return path (F) is connected to the first solid-liquid separator (C-1).

* * * * *